US011063346B2

(12) United States Patent
Yang et al.

(10) Patent No.: US 11,063,346 B2
(45) Date of Patent: Jul. 13, 2021

(54) SHARK FIN ANTENNA FOR VEHICLE

(71) Applicant: INFAC Elecs Co., Ltd., Suwon-si (KR)

(72) Inventors: Tae Hoon Yang, Gyeonggi-do (KR); Sang Hoon Lim, Gyeonggi-do (KR); Soo Young Hwang, Gyeonggi-do (KR); Ki Seok Uhm, Gyeonggi-do (KR); Kyu Chang Nam, Gyeonggi-do (KR); Chae Kyun Lim, Gyeonggi-do (KR); Jong Kook Kim, Gyeonggi-do (KR)

(73) Assignee: INFAC ELECS CO., LTD. (KR)

( * ) Notice: Subject to any disclaimer, the term of this patent is extended or adjusted under 35 U.S.C. 154(b) by 18 days.

(21) Appl. No.: 16/806,073

(22) Filed: Mar. 2, 2020

(65) Prior Publication Data

US 2021/0057805 A1 Feb. 25, 2021

(30) Foreign Application Priority Data

Aug. 19, 2019 (KR) ..... 10-2019-0100721

(51) Int. Cl.
*H01Q 1/32* (2006.01)
*H01Q 1/42* (2006.01)

(52) U.S. Cl.
CPC ..... *H01Q 1/3275* (2013.01); *H01Q 1/42* (2013.01)

(58) Field of Classification Search
CPC ..... H01Q 1/3275; H01Q 1/42; H01Q 1/1214; H01Q 21/28; H01Q 1/32; H01Q 1/38; H01Q 1/3291; H01Q 1/48; H01Q 1/3208; H01Q 1/12; H01Q 9/36; H01Q 1/521; H01Q 1/36; H01Q 1/362; H01Q 9/0407; H01Q 9/40; H01Q 11/08; H01Q 1/52; H01Q 21/30; H01Q 5/371; H01Q 5/40
USPC ..... 343/713, 859, 702
See application file for complete search history.

(56) References Cited

U.S. PATENT DOCUMENTS

2014/0292593 A1* 10/2014 Thiam ..... H01Q 9/0421 343/713
2016/0218430 A1* 7/2016 Park ..... H01Q 5/307
2016/0315378 A1* 10/2016 Kiriyama ..... H01Q 9/36
2017/0062914 A1* 3/2017 Masaka ..... H01Q 1/1214
(Continued)

FOREIGN PATENT DOCUMENTS

KR 20120086152 A 8/2012
KR 20160091090 A 8/2016

OTHER PUBLICATIONS

Korean Office Action for 10-2019-0100721 dated Mar. 9, 2020.

*Primary Examiner* — Linh V Nguyen
(74) *Attorney, Agent, or Firm* — Tarolli, Sundheim, Covell & Tummino LLP

(57) ABSTRACT

Disclosed is a shark fin antenna for a vehicle. The shark fin antenna has a pad and a base disposed on the pad to provide a space for a printed circuit board and a plurality of antenna components. The shark fin antenna includes a holder having a groove therein for exposing at least a portion of an upper surface of a printed circuit board, a first antenna unit supported by the holder and having an antenna pattern formed on a surface thereof to receive an AM/FM frequency band signal, a first auxiliary unit covering at least a portion of an upper surface of the first antenna unit, and a spring mounted in the groove to elastically support the first auxiliary unit and the first antenna unit in a vertical direction of the upper surface of the printed circuit board.

11 Claims, 10 Drawing Sheets

(56) References Cited

U.S. PATENT DOCUMENTS

| | | | | |
|---|---|---|---|---|
| 2019/0006733 | A1* | 1/2019 | Yasin | H01Q 1/36 |
| 2019/0027819 | A1* | 1/2019 | Terashita | H01Q 5/30 |
| 2019/0036198 | A1* | 1/2019 | Mizuno | H01Q 23/00 |
| 2020/0028249 | A1* | 1/2020 | Terashita | H01Q 1/521 |
| 2020/0343627 | A1* | 10/2020 | Gahner | B60R 11/0247 |
| 2021/0050655 | A1* | 2/2021 | Miura | H01Q 1/3275 |
| 2021/0098866 | A1* | 4/2021 | Kim | H01Q 9/32 |

* cited by examiner

SHARK FIN ANTENNA FOR VEHICLE

CROSS REFERENCE TO RELATED APPLICATION

The present application claims priority to Korean Patent Application No. 10-2019-0100721, filed on Aug. 19, 2019, the entire contents of which are incorporated herein for all purposes by this reference.

BACKGROUND OF THE INVENTION

1. Field of the Invention

The present invention relates generally to a shark fin antenna for a vehicle and, more particularly, to a shark fin antenna for a vehicle, the shark fin antenna having a spring for elastically supporting an antenna unit therein.

2. Description of the Background Art

Generally, a vehicle includes a helical antenna having a spiral coil-like structure in order to receive radio waves so that a person in the vehicle can listen to a radio broadcast through a radio receiver built in the vehicle. Such a helical antenna can generate resonance only at a specific frequency of a single band, so it is very difficult to have resonance at another resonance frequency desired by a user. Accordingly, there is a problem in that two frequencies cannot be simultaneously selected and received. To solve this problem, a vehicle shark fin antenna having a plurality of antennas for satisfying various frequency specifications is generally used.

Meanwhile, as next-generation high-speed mobile communications such as Long Term Evolution (LTE) and inter-vehicle wireless communications services such as Cellular Vehicle to Everything communication (CV2X) become commercially available, vehicles are equipped with devices for supporting these new services. These devices can call for help in the event of a serious accident, for example, by using a vehicle emergency rescue service such as Emergency Call (eCall), and in the Industry-Science-Medical (ISM) band, i.e. the industrial, scientific and medical frequency bands, can utilize wireless communication services can be utilized. In addition, in order to satisfy various needs of consumers, equipment for supporting services such as multimedia radio, digital multimedia broadcasting (DMB) or the like is also provided in the vehicle.

As various antennas supporting various communication standards are mounted inside a vehicle shark fin antenna, there is a demand for a vehicle shark fin antenna that has an efficient arrangement structure and durability against external impact.

SUMMARY OF THE INVENTION

Accordingly, the present invention has been made keeping in mind the above problems occurring in the related art, and an objective of the present invention is to provide a shark fin antenna for a vehicle, including a plurality of antenna units capable of supporting multiband frequencies.

Objectives to be accomplished by the present invention are not limited to the above-mentioned objective, and other objectives not mentioned will be clearly understood by those skilled in the art from the following description.

According to an aspect of the present invention, there is provided a shark fin antenna for a vehicle, wherein the shark fin antenna has a pad and a base disposed on the pad to provide a space for a printed circuit board and a plurality of antenna components, the shark fin antenna including:

a holder having a groove therein for exposing at least a portion of an upper surface of a printed circuit board;

a first antenna unit supported by the holder and having an antenna pattern formed on a surface thereof to receive an AM/FM frequency band signal;

a first auxiliary unit covering at least a portion of an upper surface of the first antenna unit; and a spring mounted in the groove to elastically support the first auxiliary unit and the first antenna unit in a vertical direction of the upper surface of the printed circuit board.

In some embodiments, the first antenna unit may include a fixing hole penetrating through the first antenna unit on a side thereof, and one end of the spring may be inserted into the fixing hole.

In some embodiments, the spring may be electrically connected to the antenna pattern of the first antenna unit.

In some embodiments, the shark fin antenna may further include at least one second antenna unit coupled to a rear end of the first antenna unit to receive a 4G (LTE), eCall, ISM wireless communication band, or 5G signal.

In some embodiments, the shark fin antenna may further include a third antenna unit disposed on the printed circuit board at a front end of the first antenna unit to receive a GPS/GNSS signal.

In some embodiments, the shark fin antenna may further include a fourth antenna unit interposed between the third antenna unit and the printed circuit board to receive an IRNSS signal.

In some embodiments, the shark fin antenna may further include a fifth antenna unit standing up on the printed circuit board at the front end of the first antenna unit to receive a DMB/DAB/ISDB-T signal.

In some embodiments, the shark fin antenna may further include a second auxiliary unit covering at least a portion of an upper surface of the fifth antenna unit.

In some embodiments, the shark fin antenna may further include a sixth antenna unit disposed on the printed circuit board and including a patch antenna composed of ceramic or a PCB-ceramic integrated material to receive satellite radio signals, and a reflector disposed on the sixth antenna unit.

In some embodiments, the shark fin antenna may further include at least one seventh antenna unit coupled to the holder to receive a 5G or CV2X signal.

In some embodiments, the shark fin antenna may further include an eighth antenna unit coupled to the holder to receive at least one or more of 5G and CV2X signals, and a ninth antenna unit coupled to the holder to receive at least one or more of 4G (LTE), eCall or CV2X signals.

According to the present invention, the shark fin antenna for a vehicle includes the holder having internal groove and the spring mounted in the groove to elastically support the antenna units, thereby improving vibration resistance.

In addition, the vehicle shark fin antenna includes the plurality of antenna units capable of supporting multiband frequencies, thereby enabling communication using various communication standards such as radio, DMB/DAB/ISDB-T, GPS/GNSS, LTE, eCall, or the like.

Objectives to be accomplished by the present invention are not limited to the above-mentioned objective, and other objectives not mentioned will be clearly understood by those skilled in the art from the following description.

BRIEF DESCRIPTION OF THE DRAWINGS

FIG. 5 is an exploded perspective view of the vehicle shark fin antenna shown in

FIG. 4;

DETAILED DESCRIPTION OF THE INVENTION

Figure 1:
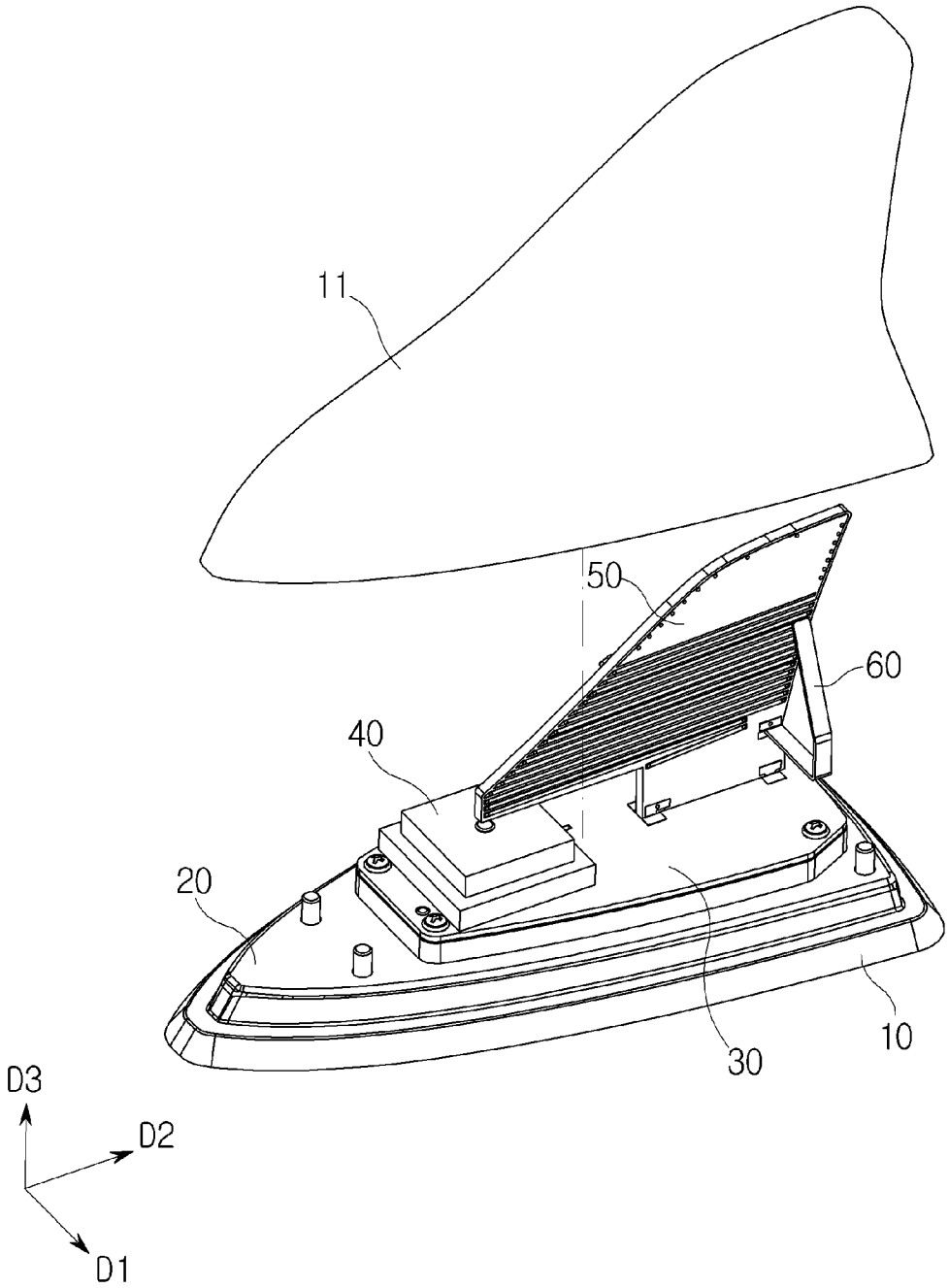
FIG. 1 is a view illustrating a configuration of a vehicle shark fin antenna according to an embodiment.

Advantages, features, and methods for accomplishing them according to the present invention will be apparent with reference to following embodiments described below in detail in conjunction with the accompanying drawings. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. The same reference numerals refer to similar elements throughout.

It will be understood that when an element is referred to as being "connected to" or "coupled to" another element, it can be directly connected or coupled to the other element or intervening elements may be present therebetween. In contrast, when an element is referred to as being "directly connected to" or "directly coupled to" another element, there are no intervening elements present. As used herein, the term "and/or" includes any and all combinations of one or more of the associated listed items.

Also, it will be understood that when an element is referred to as being "on" another element, it can be directly on the other element or intervening elements may be present therebetween. In contrast, when an element is referred to as being "directly on" another element, there are no intervening elements present.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. Thus, the exemplary terms "below" or "beneath" can, therefore, encompass the orientations of both above and below. The component may be otherwise oriented and the spatially relative descriptors used herein may likewise be interpreted accordingly.

The terminology used herein is for the purpose of describing particular embodiments only and is not intended to limit the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated components, steps, operations and/or elements, but do not preclude the presence or addition of one or more other components, steps, operations and/or elements.

It will be understood that although the terms "first," "second," etc. may be used herein to describe various components, these components should not be limited by these terms. These terms are only used to distinguish one component from another component. Thus, a first component discussed below could be termed a second component without departing from the nature of the present invention.

Unless otherwise defined, the meaning of all terms including technical and scientific terms used herein is the same as that commonly understood by one of ordinary skill in the art to which the present invention belongs. It will be further understood that terms, such as those defined in commonly used dictionaries, will not be interpreted in an idealized or overly formal sense unless expressly so defined herein.

FIG. 1 is a view illustrating a configuration of a vehicle shark fin antenna according to an embodiment.

Referring to FIG. 1, the shark fin antenna may include a pad 10, a casing 11, a base 20, a printed circuit board (PCB) 30, a first antenna unit 50, a second antenna unit 60, a third antenna unit 40, a fourth antenna unit 90, a first auxiliary unit 70, and the like.

The pad 10 may provide a space in which components such as the base 20 and the PCB 30 are mounted. The casing 11 may cover the pad 10 and the base 20, and may have a shark fin shape that increases in height as it proceeds in the D2 direction. Hereinafter, in the drawings, proximal and distal sides in the D2 direction will be referred to as front and rear sides, respectively. The base 20 may be formed of a metal material, for example.

The base 20 may be fixed to the pad 10 by bolts. The base 20 may be formed from a resilient material, for example. The pad 10 may cover a lower surface of the base 20 to provide the watertightness to the vehicle shark fin antenna.

The printed circuit board 30 may be disposed on the base 20. The printed circuit board 30 may accommodate the antenna units 40, 50, 60, and 90 mounted thereon so as to perform a function of transmitting external feed signals to each antenna unit. Specifically, the printed circuit board 30 may be provided with feed lines thereon or therein. In some embodiments, a power supply for the shark fin antenna may be an external power supply (e.g., a battery or a system module in a vehicle), and a feed line and a signal line for transmitting/receiving a signal received from the shark fin antenna may be integrally configured.

The first antenna unit 50, the second antenna unit 60, the third antenna unit 40, and the fourth antenna unit 90 may be disposed on the printed circuit board 30. As illustrated in FIG. 1, the third antenna unit 40 and the first antenna unit 50 may be sequentially disposed in the direction D2. The first antenna unit 50 disposed on the rear side may be higher in the direction D3 than the third antenna unit 40 disposed on the front side to suit to the shape of the casing 11 in which the height gradually increases in the direction D2 as described above. In addition, the casing may have a wider width in the direction D1 at a rear surface thereof, so the second antenna unit 60 disposed near the rear surface may also have a wider width in the direction D1. Hereinafter, unless otherwise mentioned, 'height' means a length extending in the direction D3.

The first antenna unit 50 may be stood up on the printed circuit board 30. The first antenna unit 50 may be an antenna unit for receiving a signal in an AM/FM frequency band.

Here, the AM frequency band may be 500 to 2000 KHz, and the FM frequency may be 70 to 110 MHz, but the present invention is not limited thereto.

The first antenna unit 50 may be, for example, an antenna unit in which an antenna pattern is formed on a glass epoxy substrate.

The fourth antenna unit 90 may be interposed between the printed circuit board 30 and the third antenna unit 40. That is, the third antenna unit 40 may be disposed to cover at least a portion of an upper surface of the fourth antenna unit 90.

The third antenna unit 40 and the fourth antenna unit 90 may be antenna units for receiving vehicle location information. The third antenna unit 40 may be an antenna unit for Global Positioning System (GPS)/Global Navigation Satellite System (GNSS), for example, and the fourth antenna unit 90 may be an antenna unit for Indian Regional Navigation Satellite System (IRNSS), for example. The third antenna unit 40 and the fourth antenna unit 90 may be patch antenna units composed of ceramic, mounted on the printed circuit board 30, or of a PCB-ceramic integrated material.

The second antenna unit 60 may be coupled to a rear end of the first antenna unit 50. Specifically, the second antenna unit 60 may be formed to protrude in the direction D1 from the side of the first antenna unit 50. Although not clearly shown in FIG. 1, the second antenna unit 60 may also protrude from the other side of the first antenna unit 50. The second antenna unit 60 may be an antenna unit for receiving an LTE or eCall signal.

The first auxiliary unit 70 may be in contact with the first antenna unit 50 to improve the reception performance of the first antenna unit 50. That is, the first auxiliary unit 70 may serve to extend the length of the antenna pattern formed on the surface of the first antenna unit 50 so that the first antenna unit 50 may be resonated with a length of $\lambda/4$. As a result, the electrical characteristics of the first antenna unit 50, for example, gain, directivity, bandwidth, and the like may be improved.

The first auxiliary unit 70 may have a circular or polygonal shape with respect to a plane, and may be disposed on the first antenna unit 50 in a shape corresponding to the inner circumferential surface of the casing 11. Such shapes of the first auxiliary unit 70 provide an increased area inside the vehicle shark fin antenna, thereby improving the reception performance of the first antenna unit 50.

In addition, the first auxiliary unit 70 may be fixed to an inner circumferential surface of the casing 11 by soldering. The first auxiliary unit 70 may be formed of a conductive material such as copper, aluminum, or stainless steel (SUS).

The vehicle shark fin antenna according to embodiments of the present invention may correspond to communication standards of various regions around the world, and accordingly, frequency bands that each antenna can support may be different.

Figure 2:
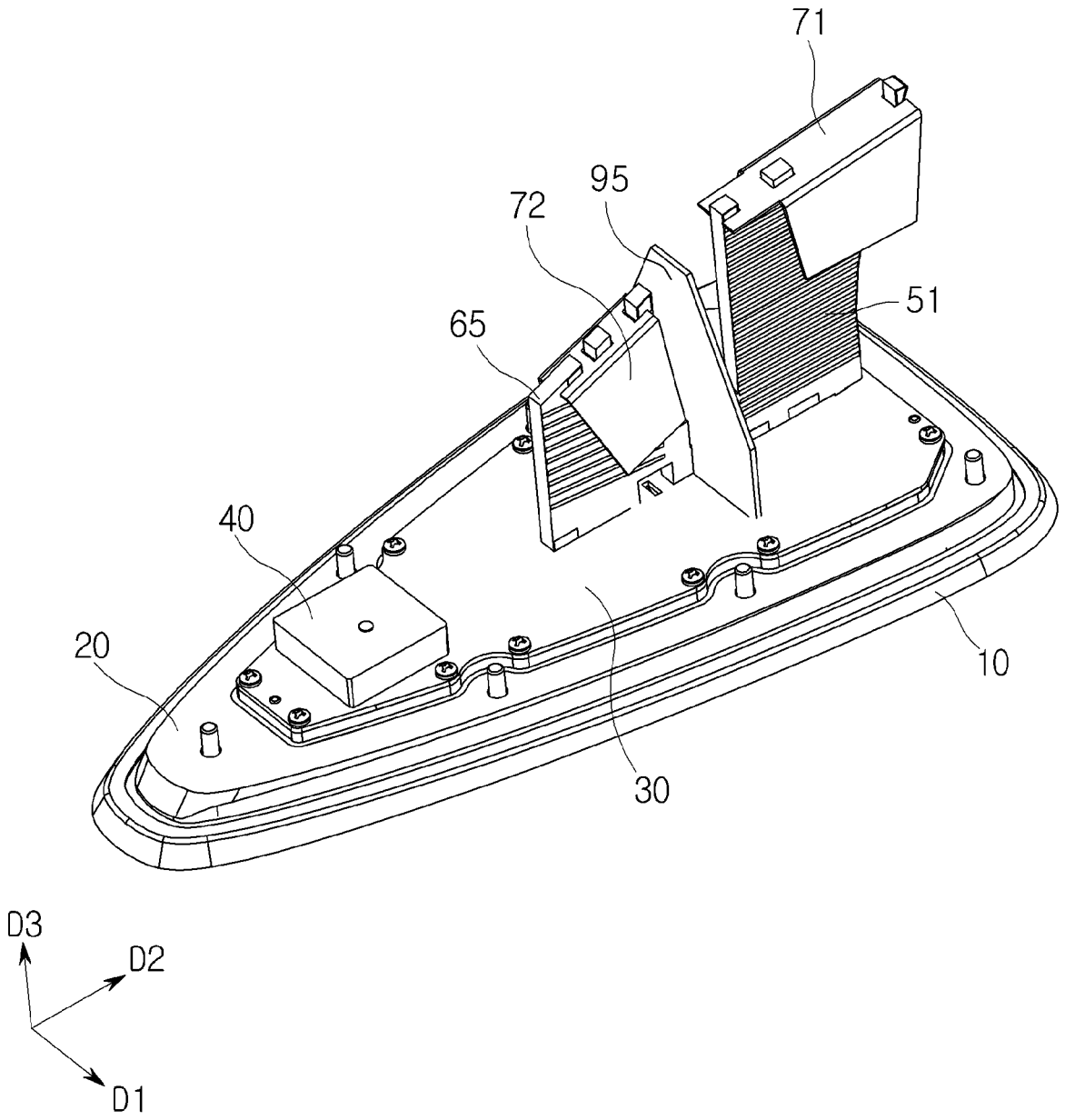
FIG. 2 is a view illustrating a configuration of a vehicle shark fin antenna according to another embodiment.

FIG. 2 is a view illustrating a configuration of a vehicle shark fin antenna according to another embodiment. Hereinafter, the configuration of the casing 11 will be omitted, and the description will be mainly focused on differences from the vehicle shark fin antenna of FIG. 1.

Referring to FIG. 2, the vehicle shark fin antenna according to another exemplary embodiment may further include a fifth antenna unit 65 and a second auxiliary unit 72.

The fifth antenna unit 65 may be an antenna unit for receiving DMB/Digital Audio Broadcasting (DAB)/Integrated Services Digital Broadcasting Terrestrial (ISDB-T) signals. Although DMB/DAB and ISDB-T may receive signals with frequency bands of 174-240 MHz and 450-810 MHz, respectively, the frequency band of the fifth antenna unit 65 is not limited thereto.

The second auxiliary unit 72 may have a circular or polygonal shape with respect to a plane and may be disposed on the fifth antenna unit 65.

The first antenna unit 51 and the first auxiliary unit 71 may correspond to the first antenna unit 50 and the first auxiliary unit 70 described with reference to FIG. 1. That is, the first antenna unit 51 may be an antenna unit for receiving a signal in an AM/FM frequency band, and the first auxiliary unit 71 may be in contact with the first antenna unit 51 to improve the reception performance of the first antenna unit 51.

The relationship between the fifth antenna unit 65 and the second auxiliary unit 72 may be similar to the relationship between the first antenna unit 51 and the first auxiliary unit 71. That is, the second auxiliary unit 72 may be disposed on the fifth antenna unit 65 in a shape corresponding to the inner circumferential surface of the casing 11, thereby improving the reception performance of the fifth antenna unit 65.

The fifth antenna unit 65 and the second auxiliary unit 72 may be disposed in front of the first antenna unit 51. Therefore, the height of the fifth antenna unit 65 may be lower than that of the first antenna unit 51 so as to match the shape of the casing (11 in FIG. 1) in which the front side is lower than the rear side.

Meanwhile, the first antenna unit 51 and the fifth antenna unit 65 may be integrally formed. That is, the first antenna unit 51 and the fifth antenna unit 65 may be formed on a single glass epoxy substrate such that the first antenna unit 51 and the fifth antenna unit 65 have different antenna patterns (in length, interval, or the like) to operate as respective antenna units for receiving different frequencies.

The shape of the second antenna unit 95 of the shark fin antenna shown in FIG. 2 may be different from that of the second antenna unit (60 in FIG. 1) described above. The second antenna unit 95 may be stand up on the printed circuit board 30 without protruding from the side of the antenna unit 51.

The second antenna unit 95 may be disposed between the first antenna unit 51 and the fifth antenna unit 65. Similar to the former embodiment, the second antenna unit 95 may be an antenna unit for receiving an LTE or eCall signal FIG. 3 is a view illustrating a configuration of a vehicle shark fin antenna according to a further embodiment.

Figure 3:
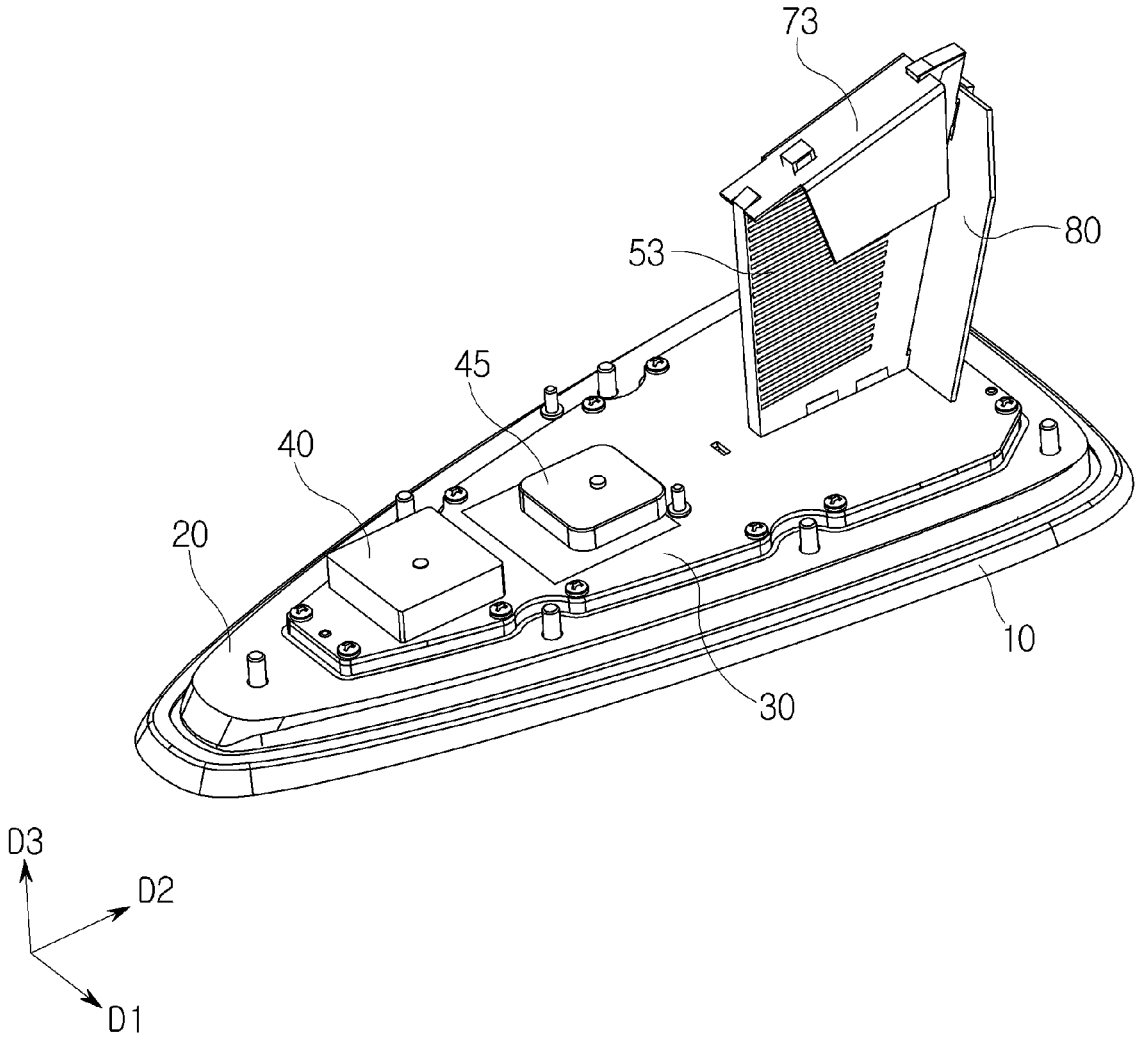
FIG. 3 is a view illustrating a configuration of a vehicle shark fin antenna according to a further embodiment.

Referring to FIG. 3, the shark fin antenna may include a second antenna unit 80 and a sixth antenna unit 45.

The second antenna unit 80 has a similar function to the second antenna unit 60 of FIG. 1, but may have a different material, shape, and arrangement from the second antenna unit 60. That is, the second antenna unit 80 may be disposed to be in contact with one side of the first antenna unit 53. The second antenna unit 80 may also be disposed to be in contact with a portion of the first auxiliary unit 73.

The second antenna unit 80 may be, for example, an antenna unit in which an antenna pattern is formed on a glass epoxy substrate.

Although the first auxiliary unit 73 is illustrated in FIG. 3 to cover the entire upper surface of the first antenna unit 53, the present invention is not limited thereto, and the first auxiliary unit 73 may expose a portion of the upper surface of the first antenna unit 53.

The sixth antenna unit 45 may be disposed behind the third antenna unit 40 on the printed circuit board 30. The sixth antenna unit 45 may be, for example, an antenna unit for receiving XM and SIRIUS satellite radio signals. The sixth antenna unit 45 may be a patch antenna unit composed of ceramic, mounted on the printed circuit board 30, or a patch antenna unit composed of a PCB-ceramic integrated material.

Although not illustrated in FIG. 3, in some embodiments, a reflector may be disposed on the sixth antenna unit 45. The reflector may be formed from, for example, a copper plate or a SUS material, and may include a PCB in some embodiments.

Figure 4:
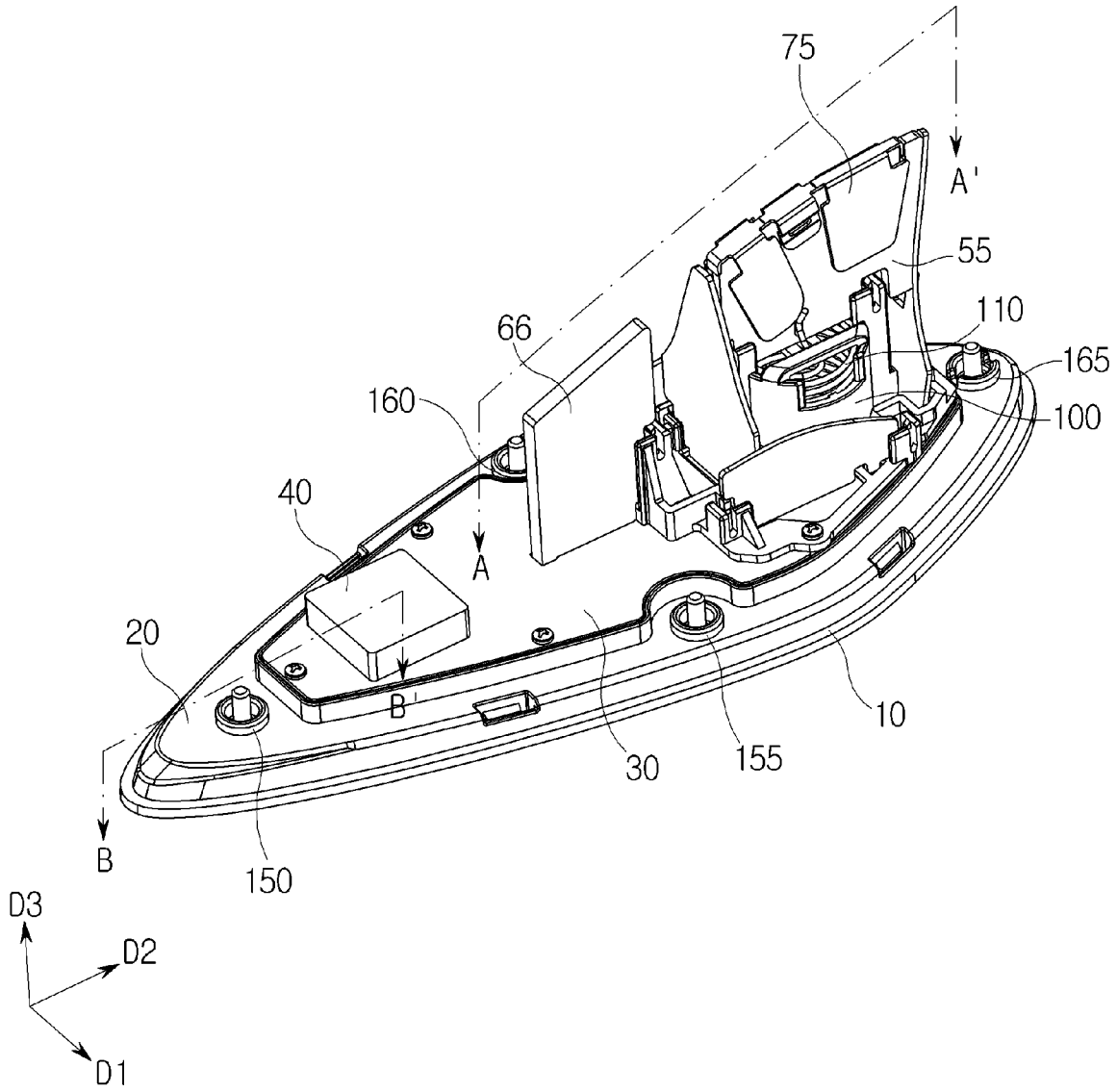
FIG. 4 is a view illustrating a configuration of a vehicle shark fin antenna according to a further embodiment.
Figure 5:
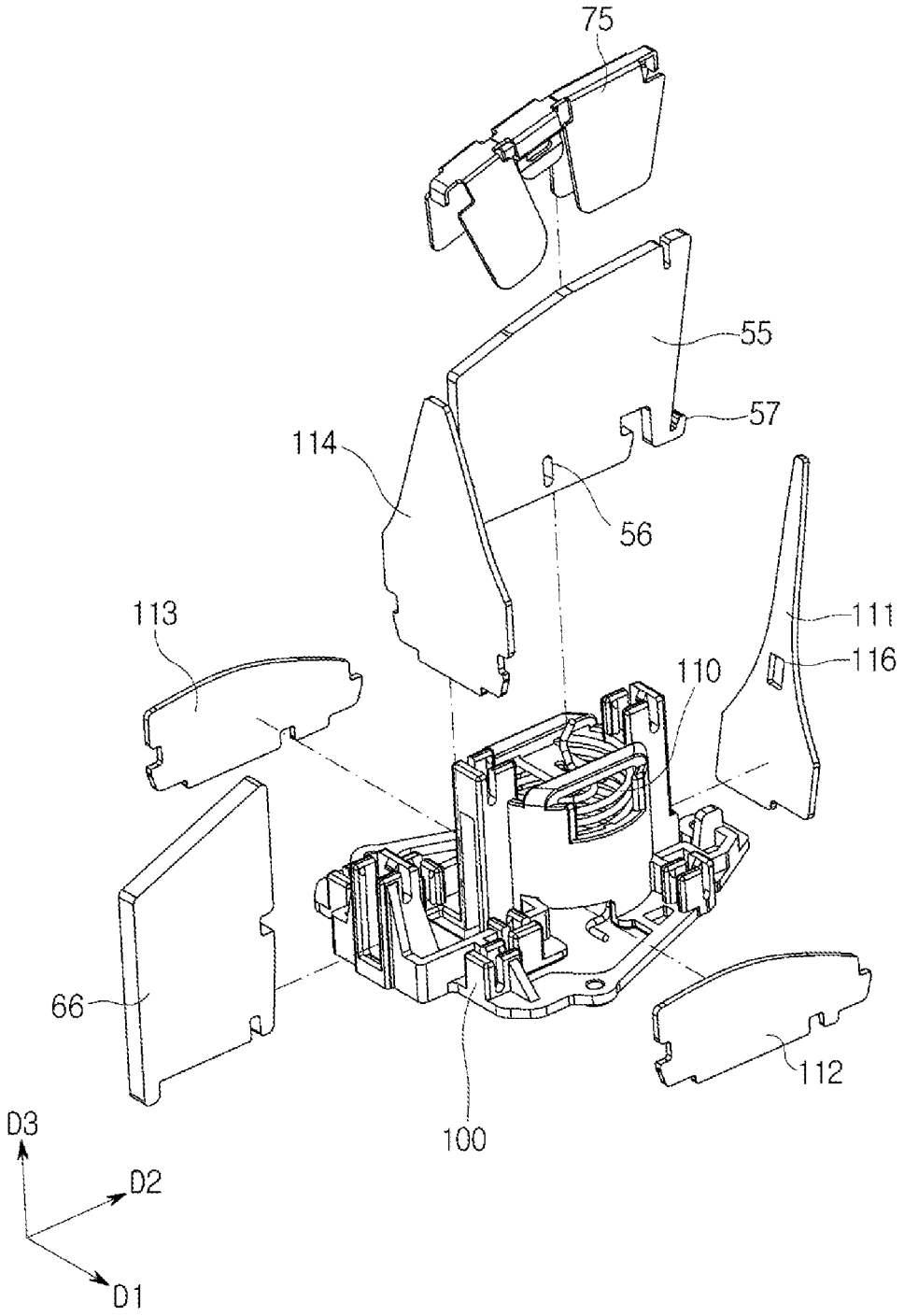

FIG. 4 is a view illustrating a configuration of a vehicle shark fin antenna according to a further embodiment, and FIG. 5 is an exploded perspective view of the vehicle shark fin antenna shown in FIG. 4.

Referring to FIGS. 4 and 5, the shark fin antenna may include a first antenna unit 55, a second antenna unit 111, a third antenna unit 40, a fifth antenna unit 66, a seventh antenna unit 112, an eighth antenna unit 113, a ninth antenna unit 114, and a holder 100 with a spring 110, which are disposed on a printed circuit board 30.

The holder 100 may support the first antenna unit 55 and the first auxiliary unit 75. The first antenna unit 55 may be coupled to the holder 100 by the engagement with a groove formed in the holder 100.

In addition to the first antenna unit 55, the second antenna unit 111 and the fifth antenna unit 66 may be coupled to the holder 100. The fifth antenna unit 66 may be coupled to the front side of the holder 100, and the second antenna unit 111 may be coupled to the rear side of the holder 100.

In addition, the seventh, eighth and ninth antenna units 112, 113, and 114 may also be coupled to the holder 100. The seventh, eighth, and ninth antenna units 112, 113, and 114 may be antenna units for receiving 4G (LTE), 5G, and Cellular Vehicle-to-Everything (CV2X) signals, respectively. Specifically, The seventh antenna unit 112 and the eighth antenna units 113 may be antenna units for receiving 5G and CV2X signals, and the ninth antenna unit 114 may be an antenna for receiving 4G (LTE) and 5G signals.

In some embodiments, the eighth antenna unit 113 and the ninth antenna unit 114 may be omitted. In this case, the second antenna unit 111 may be configured to receive 5G and 4G (LTE) signals, and the seventh antenna unit 112 may be configured to receive CV2X and 5G signals.

A plurality of boss-type through holes 150, 155, 160, and 165 may be disposed in the base 20. These boss-type holes correspond to portions at which the casing (11 in FIG. 1) is engaged.

Figure 6:
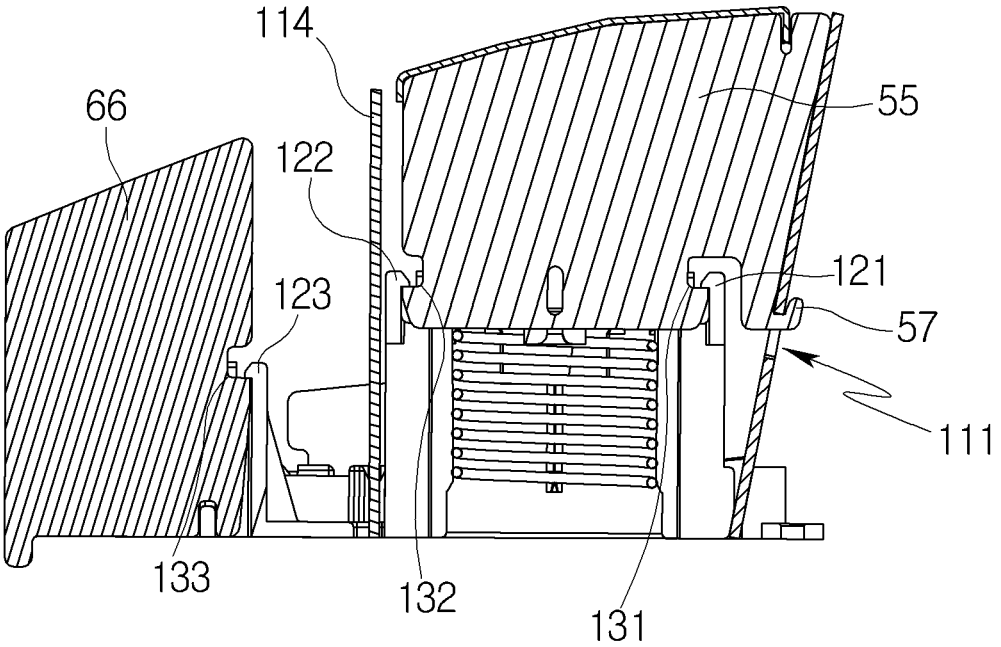
FIG. 6 is a cross-sectional view taken along line A-A' of FIG. 4.

FIG. 6 is a cross-sectional view taken along line A-A' of FIG. 4. For convenience of illustration, components other than the holder 100 and the antenna units 55, 66, 111, and 114 are omitted.

Referring to FIG. 6, the engagement of the antenna units 55, 66, 111, 114 with the holder 100 is illustrated.

The first antenna unit 55 has a protrusion 57 protruding toward the rear side, and the protrusion 57 may have a ring shape bent in the direction D3. The protrusion 57 is engaged with the second antenna unit 111 through a hole 116 of the second antenna unit 111.

The holder 100 includes a first jaw-shaped fixing part 121 curved in the front direction and a second jaw-shaped fixing part 122 curved in the rear direction. The first fixing part 121 and the second fixing part 122 are engaged with first and second recessed portions 131 and 132, respectively, which are formed to be concave inwardly from the first antenna unit 55, thereby fixing the first antenna unit 55 to the holder 100.

In addition, the holder 100 may include a third fixing part 123 having a jaw shape curved in the front direction, and the third fixing part 123 is engaged with a third recessed portion recessed inwardly of the fifth antenna unit 66, thereby fixing the fifth antenna unit 66 to the holder 100.

Although not shown, the seventh to ninth antenna units 112 to 114 may be electrically connected to wiring on or in the printed circuit board 30 through soldering.

Figure 7A:
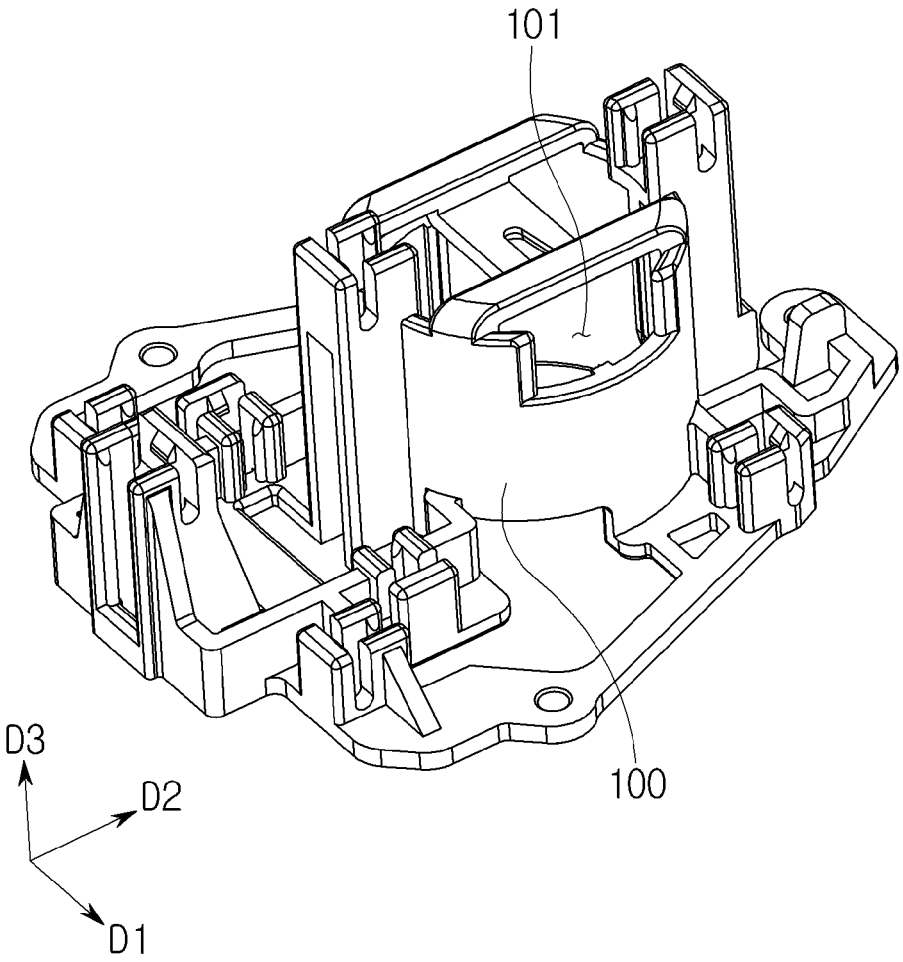
FIGS. 7A and 7B are detailed views illustrating a holder 100 and a spring 110, respectively.
Figure 7B:
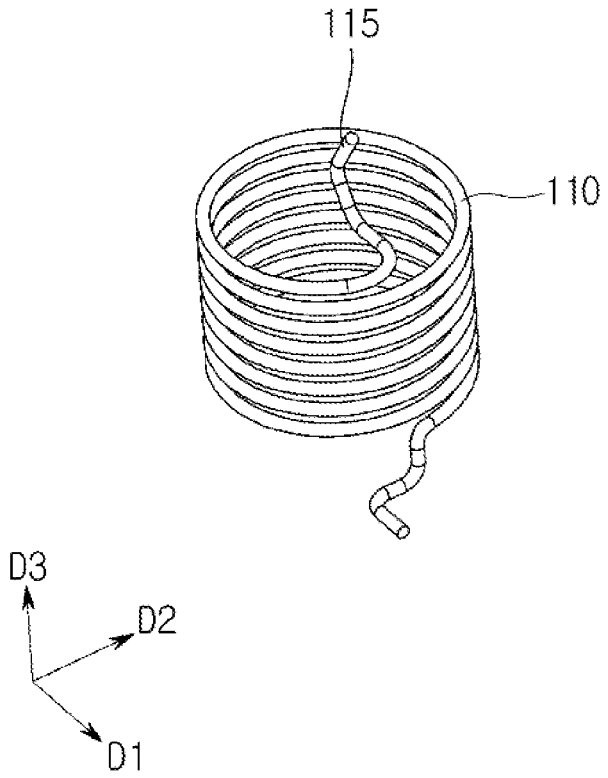

FIGS. 7A and 7B are detailed views illustrating a holder 100 and a spring 110, respectively.

Referring to FIGS. 7A and 7B, the holder 100 has a groove 101 formed therein, and a spring 110 is inserted and disposed in the groove 101.

The spring 110 disposed in the groove 101 of the holder 100 may elastically support the first antenna unit 55 and the first auxiliary unit 75. That is, the spring 110 provides an elastic force against vibration generated in the direction D3 with respect to the first antenna unit 55 and the first auxiliary unit 75, thereby protecting the first antenna unit 55 and the first auxiliary unit 75. Accordingly, during transportation or assembly of the shark fin antenna, after assembly of the shark fin antenna to a vehicle, vibration resistance and durability may be improved.

A first end 115 of the spring may be inserted into the fixing hole 56 formed through the side of the first antenna unit 55. The first end 115 of the spring inserted into the fixing hole 56 may be soldered to the first antenna unit 55.

In addition, the spring 110 may be electrically connected to the antenna pattern formed on the surface of the first antenna unit 55 through soldering. In this case, the spring 110 may serve as an antenna, thereby having an effect of the antenna pattern of the first antenna unit 55 being extended.

Figure 8:
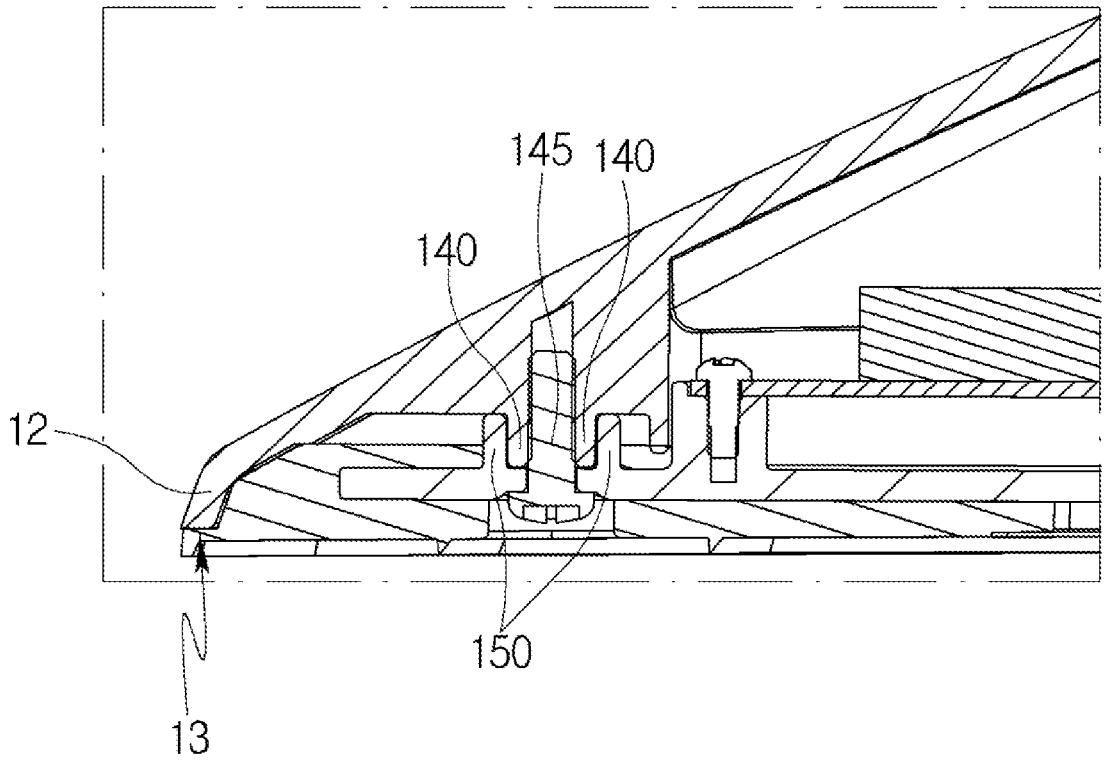
FIG. 8 is a cross-sectional view taken along the line B-B' of FIG. 4.

FIG. 8 is a cross-sectional view taken along the line B-B' of FIG. 4.

Referring to FIG. 8, a boss part 140 may be formed to extend downwards from an inner surface of the casing (11 in FIG. 1). Since an inner diameter of the boss-type through hole 150 is the same as an outer diameter of the boss part 140, the boss-type through hole 150 is fitted and coupled around the boss part 140. The boss-type through hole 150 and the boss part 140 may be coupled together by a bolt 145, so that the casing 11 and the base 20 may be coupled together.

Although not entirely illustrated in FIG. 8, other boss parts may be disposed at positions corresponding to the remaining boss-type through holes 155, 160, and 165 inside the casing 11, and after they are coupled together, they may be fixed by bolts.

The pad 10 may have a step portion 13 protruding to generate a step at an end of the front side thereof. The step portion 13 may be formed around the pad 10 and may have a predetermined width. One end 12 of the casing 11 may be fittingly engaged with the step portion 13 of the pad, thereby sealing the shark fin antenna.

Figure 9:
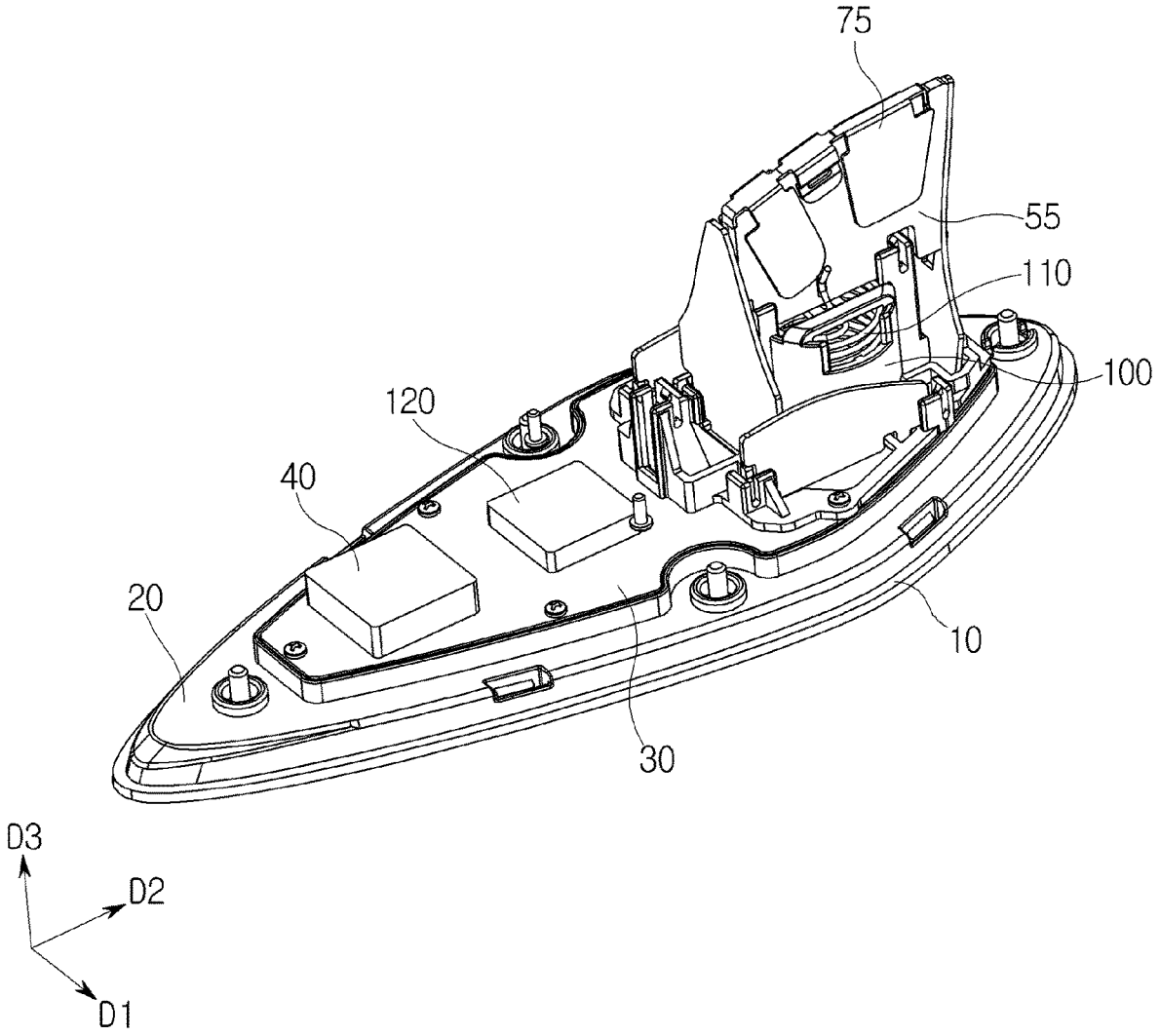
FIG. 9 is a view illustrating a configuration of a vehicle shark fin antenna according to a further embodiment.

FIG. 9 is a view illustrating a configuration of a vehicle shark fin antenna according to a further embodiment.

Referring to FIG. 9, compared to the shark fin antenna of FIG. 4, the shark fin antenna of this embodiment includes a fifth antenna unit 120 instead of the fifth antenna unit 66.

The fifth antenna unit 120 may be a ceramic patch antenna mounted on the printed circuit board 30. Similar to the sixth antenna unit 45 of FIG. 3, a reflector may further be disposed on the fifth antenna unit 120.

In the foregoing description, like components are described under the premise that they perform the same function. That is, the first antenna units 50, 51, 53, and 55 may be antenna units for receiving signals of the same frequency, for example, in AM/FM frequency band. Other antenna units referred to as the same name also receive signals in the same frequency band.

While the exemplary embodiments of the present invention have been described in the detailed description, the present invention is not limited thereto, but should be construed as including all of modifications, equivalents, and substitutions falling within the spirit and scope of the invention defined by the appended claims.

The invention claimed is:

1. A shark fin antenna for a vehicle, wherein the shark fin antenna has a pad and a base disposed on the pad to provide a space for a printed circuit board and a plurality of antenna components, the shark fin antenna comprising:

a holder having a groove therein for exposing at least a portion of an upper surface of a printed circuit board;

a first antenna unit supported by the holder and having an antenna pattern formed on a surface thereof to receive an AM/FM frequency band signal;

a first auxiliary unit covering at least a portion of an upper surface of the first antenna unit; and a spring mounted in the groove to elastically support the first auxiliary unit and the first antenna unit in a vertical direction of the upper surface of the printed circuit board.

2. The shark fin antenna for a vehicle according to claim 1, wherein the first antenna unit includes a fixing hole penetrating through the first antenna unit on a side thereof, and one end of the spring may be inserted into the fixing hole.

3. The shark fin antenna for a vehicle according to claim 2, wherein the spring is electrically connected to the antenna pattern of the first antenna unit.

4. The shark fin antenna for a vehicle according to claim 1, further comprising: at least one second antenna unit coupled to a rear end of the first antenna unit to receive a 4G (LTE), eCall, ISM wireless communication band, or 5G signal.

5. The shark fin antenna for a vehicle according to claim 1, further comprising: a third antenna unit disposed on the printed circuit board at a front end of the first antenna unit to receive a GPS/GNSS signal.

6. The shark fin antenna for a vehicle according to claim 5, further comprising: a fourth antenna unit interposed between the third antenna unit and the printed circuit board to receive an IRNSS signal.

7. The shark fin antenna for a vehicle according to claim 1, further comprising: a fifth antenna unit standing up on the printed circuit board at the front end of the first antenna unit to receive a DMB/DAB/ISDB-T signal.

8. The shark fin antenna for a vehicle according to claim 7, further comprising: a second auxiliary unit covering at least a portion of an upper surface of the fifth antenna unit.

9. The shark fin antenna for a vehicle according to claim 1, further comprising: a sixth antenna unit disposed on the printed circuit board and including a patch antenna composed of ceramic or PCB-ceramic integrated material to receive satellite radio signals, and a reflector disposed on the sixth antenna unit.

10. The shark fin antenna for a vehicle according to claim 1, further comprising: at least one seventh antenna unit coupled to the holder to receive a 5G or CV2X signal.

11. The shark fin antenna for a vehicle according to claim 10, further comprising: an eighth antenna unit coupled to the holder to receive at least one or more of 5G and CV2X signals, and a ninth antenna unit coupled to the holder to receive at least one or more of 4G (LTE), eCall and CV2X signals.

* * * * *